United States Patent [19]

Fisher

[11] 4,061,127

[45] Dec. 6, 1977

[54] MOBILE HOME FIREPLACE WITH EXTERNAL AIR SUPPLY

[76] Inventor: Eugene W. Fisher, 2040 W. Clay St., Dallas, Oreg. 97338

[21] Appl. No.: 573,540

[22] Filed: May 1, 1975

[51] Int. Cl.[2] ..... F24B 1/18

[52] U.S. Cl. ..... 126/120; 126/140; 126/202; 126/276; 296/23 R

[58] Field of Search ..... 126/120, 121, 276, 56, 126/57, 140, 143, 202; 237/51; 296/23 R

[56] References Cited

U.S. PATENT DOCUMENTS

| | | | |
|---|---|---|---|
| 1,588,587 | 6/1926 | Klaus | 237/51 |
| 2,497,486 | 2/1950 | Barber | 126/120 |
| 2,747,568 | 5/1956 | Dupler | 237/51 |
| 2,828,078 | 3/1958 | Snodgrass | 126/121 X |
| 3,094,980 | 6/1963 | Inabnit | 126/121 |
| 3,339,540 | 9/1967 | Kreider | 126/121 |
| 3,910,251 | 10/1975 | Andrew | 126/120 |
| 3,970,067 | 7/1976 | Vaughn | 126/120 |

*Primary Examiner*—Ronald C. Capossela
*Attorney, Agent, or Firm*—Francis Swanson

[57] ABSTRACT

A fireplace for use in mobile homes is disclosed. The fireplace has a plurality of doors which seal the combustion chamber. An air duct leads from the combustion chamber of the fireplace through the floor of the mobile home so as to provide an external source of combustion air for the fireplace when the doors close and seal the fireplace combustion chamber from the interior of the mobile home.

3 Claims, 3 Drawing Figures

Fig 1
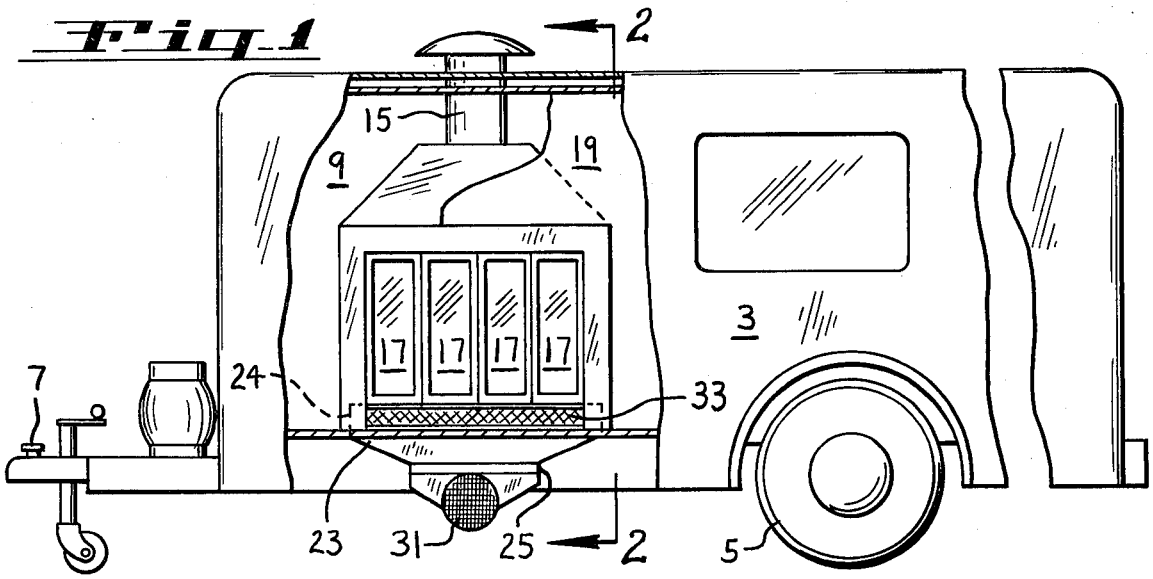
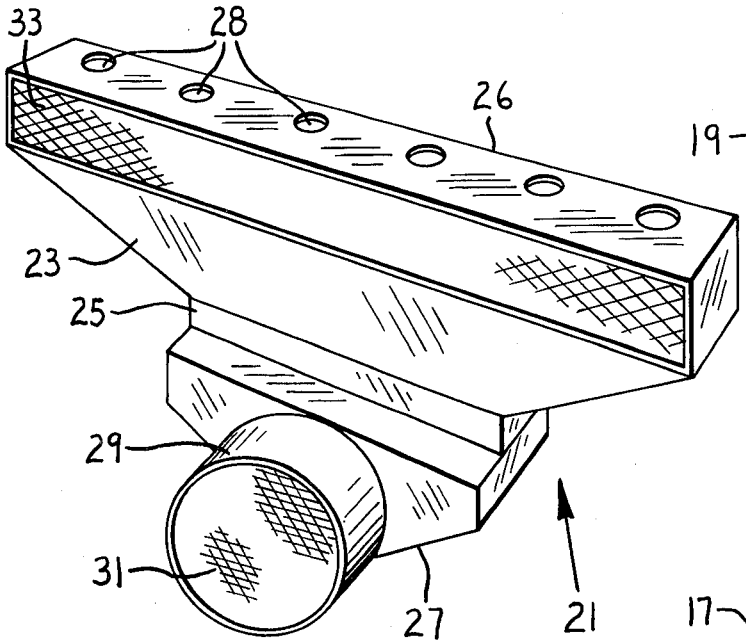
Fig 3
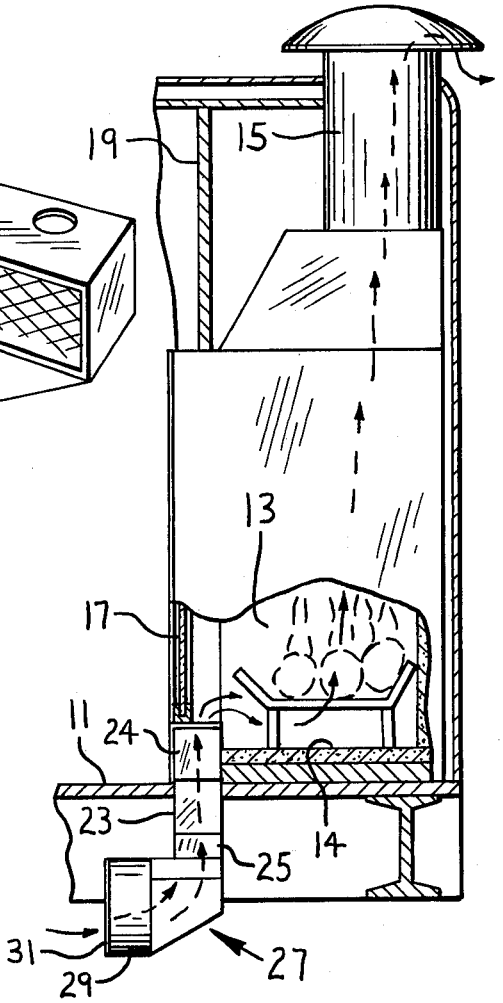
Fig 2

MOBILE HOME FIREPLACE WITH EXTERNAL AIR SUPPLY

BACKGROUND OF THE INVENTION

Field of the Invention

This invention relates to fireplaces in general and more specifically to those used in mobile homes. It is well known that when material is burned in a fireplace, oxygen for combustion is drawn from the room in which the fireplace is located. The burning material sets up a draft which draws air from the room. The air in the combustion process creates smoke and heated gases which rise through the chimney of the fireplace to the outside of the building or enclosure. If the room in which the fireplace is located is tightly sealed, insufficient air may be available to produce adequate combustion and the fireplace will smoke. In some cases, if the draft is insufficient, the burning materials may merely smolder and in the process produce dangerous or lethal gases such as carbon monoxide. Other material such as charcoal briquets consume great quantities of oxygen during the combustion process and may produce dangerously low levels of oxygen within a tightly sealed room.

Modern mobile homes are specifically designed to close very tightly. Burning materials in a fireplace inside such an enclosure could produce oxygen starvation and thus suffocate occupants within the mobile home. It is thus desirable that the combustion chamber of a fireplace in a mobile home be isolated from the room itself and that a separate souce of air be supplied to the combustion chamber.

SUMMARY OF THE INVENTION

It is a paramount object of the present invention to provide a fireplace having means for sealing the fireplace combustion chamber off from the room in which the fireplace is located. It is a further object of the invention to provide a separate source of air to the sealed combustion chamber of the fireplace wherein the source of air originates entirely outside the mobile home.

Further objects and advantages of the invention will become apparent to those skilled in the art by reference to the drawings and specifications which follow.

DESCRIPTION OF THE DRAWINGS

FIG. 1 is a side view of a mobile home partially broken away to show a front elevational view of the fireplace contained within the mobile home and the air duct protruding through the floor of the mobile home to a source of external air.

FIG. 2 is a sectional view taken along lines 2—2 of FIG. 1 showing the fireplace mounted against an exterior wall and resting on the floor of the mobile home and showing the duct protruding through said floor.

FIG. 3 is a perspective view of the fireplace air duct showing the relationship of its parts.

DESCRIPTION OF THE PREFERRED EMBODIMENT

Referring now to the drawings, FIG. 1 shows a mobile home having a body 1, a sidewall 3, wheels 5 and a towing hitch 7. The wall 3 is broken away to show the fireplace mounted against opposite wall 9.

Referring now to FIG. 2, the fireplace is mounted against wall 9 and rests upon floor 11. The fireplace has a combustion chamber 13 having a chimney 15 which leads through the roof of the mobile home to provide an exit for the smoke from the burning materials within the combustion chamber 13. A plurality of doors 17 seal the combustion chamber of the fireplace from the room in which the fireplace is mounted. An inner decorative wall 19 surrounds the doors 17 and rises to the ceiling of the mobile home. This decorative wall 19 seals the chimney from view and lends a pleasing appearance to the fireplace structure.

As shown in FIG. 3, the duct 21 has a flared upper end 23 capped with a first rectangular box section 24. The bottom of flared end 23 is connected to a second rectangular elongated box section 25. The end of the box section 25 opposite the flared end 23 has an elbow 27 mounted thereon. The elbow is so constructed that its verticle end mates to the box section 25 and its horizontal end terminates in a large diameter metal tube 29. The end of the tube 29 is covered with a porous screen 31.

Box section 24 on flared end 23 of duct 21 protrudes into the combustion chamber 13 just inside doors 17 and several inches above floor 14 of the combustion chamber 13. Positioning box section 24 of the duct 21 several inches above floor 14 prevents ashes from within combustion chamber 13 from entering the duct and accumulating in the lower portion of elbow 27 and eventually blocking off the air supply. The box section 24 is covered with a metal plate 26 having a plurality of air holes 28 therein. An optional decorative plate 33 may be mounted on box section 24 to add a more pleasing appearance to the fireplace if desired. The duct may be secured to the floor of the mobile home by any one of numerous conventional methods well-known in the mobile home construction art. It should be noted from FIG. 2 that there is no damper or other obstruction of any kind in the air passageway of the duct.

OPERATION OF THE PREFERRED EMBODIMENT

When it is desired to use the fireplace, the material to be burned, shown here as logs on a grate, is placed on floor 14 behind the protruding section 24 of duct 21. As soon as the material is ignited in combustion chamber 13, doors 17 are immediately closed sealing off the interior of the mobile home from the combustion chamber 13. As combustion proceeds, air is drawn through tube 29 into elbow 27, through box section 25, flared end 23 into box section 24 where it exits through holes 28 in plate 26 into combustion chamber 13. Air is thus supplied from outside the mobile home to burning material inside the fireplace while the fireplace is completely sealed from the interior of the mobile home during the entire time the material is being burned. The illustrated construction thus eliminates the possibility of oxygen starvation within the mobile home because of combustion within the fireplace. Although a preferred form of the invention has been illustrated and that form described in detail, it will be apparent to those skilled in the art that various modifications may be made therein without departing from the spirit of the invention or from the scope of the appended claims.

I claim:

1. An improved fireplace comprising:

a combustion chamber;

a chimney connected to the chamber;

a solid door for substantially sealing the chamber off from the air supply within the interior of a dwelling containing the fireplace;

a combustion chamber air supply duct having an upper end and a lower end, the upper end defining an air inlet hole and terminating within the combustion chamber by protrusion through the chamber floor to a point above said floor but below and behind the door so that burning materials and hot ashes on the floor are substantially prevented from entering the duct, the lower end of the duct having an elongate section protruding through the floor of the dwelling to a position below the floor outside the dwelling; the duct defining a substantially unobstructed air path from a source of exterior air to the interior of the chamber behind the door and above the chamber floor when the chamber is sealed.

2. The combination of a mobile home having a floor and at least one interior room, a fireplace having a combustion chamber having with a lower floor for burning material thereon and a chimney connected to the chamber a solid door operatively connected to the fireplace to substantially seal off the combustion chamber from air from within the interior of the mobile home during burning of materials in the chamber, and an external air supply source, wherein the improvement comprises:

an L-shaped external air supply duct defining a direct and substantially unobstructed air path from a source of air outside the mobile home to the combustion chamber floor, one end of the duct terminating in a plate defining a plurality of air holes and protruding through the chamber floor below and behind the sealing door to a point substantially above the floor of the combustion chamber so that burning materials and hot ash are substantially prevented from entering the duct, the duct having a downwardly depending section protruding through the chamber floor and the floor of the mobile home to a point below both floors and outside the mobile home, the downwardly depending section connected to a hollow horizontal section lying below the mobile home.

3. In combination with a mobile home having a floor and at least one room, a fireplace having a chimney, the fireplace including a combustion chamber having a floor for burning material thereon, a solid door on the chamber for sealing the chamber off from air within the room during burning of materials within the chamber, wherein the improvement comprises:

a combustion chamber air supply duct operatively connected to the interior of the combination chamber, the duct further comprises:

a perpendicular L-shaped duct one end of which defines a hollow elongate flared duct section and the other end of which defines a horizontal hollow pipe section, the flared duct section having an elongate box section thereon which defines at least one combustion chamber air supply hole, the box section protruding through the combustion chamber floor from below to a position behind the door and above the chamber floor and below the bottom of door so that entry of burning materials and hot ash from said materials into the duct is substantially prevented; the pipe section lying in a horizontal plane outside the mobile home below the mobile home floor and capped at its terminal end by a porous member.

* * * * *